US010999682B2

(12) United States Patent
Soronen et al.

(10) Patent No.: US 10,999,682 B2
(45) Date of Patent: May 4, 2021

(54) TRANSDUCER ARRANGEMENT

(71) Applicant: PS Audio Design Oy, Oulu (FI)

(72) Inventors: Petri Soronen, Oulu (FI); Vesa Kajanus, Oulu (FI); Petteri Luukkanen, Tupos (FI); Harri Kankaanpää, Oulu (FI)

(73) Assignee: PS Audio Design Oy, Oulu (FI)

( * ) Notice: Subject to any disclaimer, the term of this patent is extended or adjusted under 35 U.S.C. 154(b) by 0 days.

(21) Appl. No.: 16/609,328

(22) PCT Filed: Oct. 15, 2018

(86) PCT No.: PCT/FI2018/050740
§ 371 (c)(1),
(2) Date: Oct. 29, 2019

(87) PCT Pub. No.: WO2019/081805
PCT Pub. Date: May 2, 2019

(65) Prior Publication Data

US 2020/0260189 A1 Aug. 13, 2020

(30) Foreign Application Priority Data

Oct. 25, 2017 (FI) ..... 20175942
Mar. 16, 2018 (FI) ..... 20185251

(51) Int. Cl.
*H04R 11/00* (2006.01)
*H04R 9/06* (2006.01)
*H04R 11/02* (2006.01)

(52) U.S. Cl.
CPC ..... *H04R 9/06* (2013.01); *H04R 11/02* (2013.01); *H04R 2400/11* (2013.01)

(58) Field of Classification Search
CPC ..... H04R 11/02; H04R 13/00; H02K 33/06; H02K 35/02
See application file for complete search history.

(56) References Cited

U.S. PATENT DOCUMENTS 4,242,541 A 12/1980 Ando
6,141,427 A * 10/2000 Fukuda ..... H04R 11/02 381/151
(Continued)

FOREIGN PATENT DOCUMENTS

CN 1943272 B 6/2012
EP 1 845 750 A1 10/2007
(Continued)

OTHER PUBLICATIONS

Finnish Patent Search Report received for Finland Patent Application Serial No. 20175942 dated May 15, 2018, 2 pages.
(Continued)

*Primary Examiner* — Ryan Robinson
(74) *Attorney, Agent, or Firm* — FisherBroyles, LLP

(57) ABSTRACT

An arrangement for generating vibration according to an electrical input signal includes a first permanent magnet arrangement including a first permanent magnet, a frame including magnetic material, a second permanent magnet configured to be arranged between the first permanent magnet and the frame and to be coupled with the frame, one or more portion of the frame extending at least in one direction over an edge area of the second permanent magnet. The second permanent magnet is further configured to face, at a distance, the first permanent magnet such that a magnetic interaction between the first permanent magnet and the second permanent magnet causes a first force to a surface of an apparatus, wherein the frame is configured to be magnetized by the second permanent magnet in order to cause magnetic interaction between the one or more portion of the frame and the first permanent magnet arrangement in order to cause a second force to the surface having an opposite direction compared with the first force.

15 Claims, 10 Drawing Sheets

(56) References Cited

U.S. PATENT DOCUMENTS

| | | | | |
|---|---|---|---|---|
| 6,658,133 | B1 * | 12/2003 | Usuki | H04R 13/02 340/388.1 |
| 6,920,230 | B2 | 7/2005 | Usuki et al. | |
| 7,724,915 | B2 | 5/2010 | Matsumura et al. | |
| 7,953,240 | B2 | 5/2011 | Matsumura et al. | |
| 9,288,591 | B1 * | 3/2016 | Dong | H04R 11/00 |
| 9,331,558 | B2 * | 5/2016 | Clamme | H01F 7/10 |
| 10,542,348 | B2 * | 1/2020 | Iwakura | H04R 1/10 |
| 2002/0037089 | A1 | 3/2002 | Usuki et al. | |
| 2002/0136424 | A1 | 9/2002 | Usuki et al. | |
| 2003/0068063 | A1 | 4/2003 | Usuki et al. | |
| 2007/0165902 | A1 | 7/2007 | Matsumura et al. | |
| 2007/0206830 | A1 | 9/2007 | Usuki et al. | |
| 2008/0273740 | A1 | 11/2008 | Takewa | |
| 2009/0097694 | A1 | 4/2009 | Takewa | |
| 2014/0106137 | A1 | 4/2014 | Kondo et al. | |
| 2015/0156581 | A1 * | 6/2015 | Efrati | H02K 33/16 381/98 |
| 2020/0314547 | A1 * | 10/2020 | Kim | H04R 1/028 |

FOREIGN PATENT DOCUMENTS

| | | | |
|---|---|---|---|
| EP | 1 928 210 | A4 | 8/2010 |
| EP | 2 305 754 | A1 | 4/2011 |
| EP | 2 980 172 | A1 | 2/2016 |
| EP | 3 103 831 | A1 | 12/2016 |
| EP | 3 309 613 | A1 | 4/2018 |
| EP | 3 309 615 | A1 | 4/2018 |
| EP | 3 441 818 | A1 | 2/2019 |
| JP | H10301573 | A | 11/1998 |
| JP | 2004-088646 | A | 3/2004 |
| JP | 2006-173997 | A | 6/2006 |
| JP | 2007-006459 | A | 1/2007 |
| JP | 2007-104634 | A | 4/2007 |
| JP | WO2006098243 | A1 | 8/2008 |
| JP | 6108649 | B2 | 4/2017 |
| KR | 10-1250288 | B1 | 4/2013 |
| KR | 10-1351892 | B1 | 1/2014 |
| WO | 03/41449 | A1 | 5/2003 |
| WO | 03/092323 | A1 | 11/2003 |
| WO | 2005/099303 | A1 | 10/2005 |
| WO | 2015/136656 | A1 | 9/2015 |
| WO | 2016/079385 | A1 | 5/2016 |
| WO | WO-2016079385 | A1 * | 5/2016 ..... H04R 11/02 |

OTHER PUBLICATIONS

Di Cola et al., "Subwoofer design with Moving Magnet Linear Motor" Audio Engineering Society, Presented at the 137th Convention, Oct. 2014, 14 pages.

International Preliminary Report on Patentability received for PCT Application Serial No. PCT/FI2018/050740 dated Oct. 2, 2019, 13 pages.

Korean Office action received for Korean Patent application No. 10-2019-7032380 dated Jun. 22, 2020, 14 pages (Including English Translation).

Extended European Search report received for European application No. 19184083.4 dated Nov. 8, 2019, 7 pages.

Decision to Grant a Patent for an Invention received for Russian Patent Application Serial No. 2020115470/28 dated Nov. 2, 2020. (English Translation Submitted).

* cited by examiner

TRANSDUCER ARRANGEMENT

CROSS-REFERENCE TO RELATED APPLICATIONS

This application is a national phase of international application no. PCT/FI2018/050740 filed Oct. 15, 2018, which claims priority from Finnish Patent Application No. 20185251, filed Mar. 16, 2018 and Finnish Patent Application No. 20175942, filed Oct. 25, 2017 which are incorporated by reference herein in their entireties.

BACKGROUND

Field

The invention relates to transducers, such as loudspeakers, for converting electrical energy into vibration.

Description of the Related Art

Transducers may convert energy from one form to another and are applied in devices like the loudspeakers. Loudspeakers are widely used in many different places to produce a sound. An application WO 2016/079385 discloses a loudspeaker apparatus. The loudspeaker apparatus comprises a first magnet coupled with a surface and a second magnet coupled with a base. The loudspeaker apparatus further comprises at least one supporting member. The first magnet, the second magnet and the supporting member keep the surface in an equilibrium state. The first and the second magnets are arranged to face each other and a coil is arranged between the magnets to generate a force when an electrical signal is fed into the coil. The force breaks the equilibrium state of the surface. It may be beneficial to provide further solutions that may, for example, be applicable to the described arrangement. For example, further solutions for enabling equilibrium state may be beneficial.

SUMMARY

According to an aspect of there is provided the subject matter of the independent claims.

Some embodiments are described in the dependent claims.

According to an aspect there is provided an arrangement for generating vibration according to an electrical input signal, the arrangement comprising: a first permanent magnet configured to be coupled with a surface of an apparatus; a second permanent magnet configured to be coupled with a base of the apparatus, the first and second permanent magnets configured to be arranged to face each other and to cause a first force to the surface; and a coil coupled with an input for receiving an electrical input signal, the coil configured to generate a magnetic field according to the electrical input signal in order to displace the surface to generate vibration, wherein the arrangement further comprises: a first magnetic object configured to be coupled with the surface and to at least partially encircle the first permanent magnet; and a second magnetic object configured to be coupled with the base and to at least partially encircle the second permanent magnet, wherein at least one of the first and second magnetic objects comprises a permanent magnet, the first and second magnetic objects configured to be arranged to face each other and to cause a second force to the surface having an opposite direction compared with the first force.

In an embodiment, the coil is configured to be arranged between the first and second permanent magnets.

In an embodiment, the coil is configured to be arranged around one of the first permanent magnet and second permanent magnet.

In an embodiment, the arrangement is for generating an audio output according to the electrical input signal.

In an embodiment, the second magnetic object comprises a permanent magnet.

In an embodiment, the first magnetic object comprises a permanent magnet.

In an embodiment, a first pole of the first permanent magnet faces the second permanent magnet, and wherein a second pole of the first permanent magnet is fixed to the first magnetic object to magnetize the first magnetic object facing the second magnetic object.

In an embodiment, the first magnetic object encircles the first permanent magnet and the second magnetic object encircles the second permanent magnet, and wherein at least one of the first magnetic object, the second magnetic object comprises an axially magnetized permanent ring magnet.

In an embodiment, said coil is a first coil configured to generate a first magnetic field according to the electrical input signal, the arrangement further comprising: a second coil arranged between the first and second magnetic objects and configured to generate a second magnetic field according to an electrical input signal.

In an embodiment, the arrangement further comprises: means for shifting phase of the electrical input signal such that a phase of the electrical input signal inputted into the first coil is substantially 180 degrees different compared with a phase of the electrical input signal inputted into the second coil.

In an embodiment, a winding of the first coil is opposite to a winding of the second coil.

In an embodiment, the arrangement further comprises: at least one further element comprising magnetic material and arranged between the first permanent magnet and a permanent magnet of the first magnetic object and/or between the second permanent magnet and a permanent magnet of the second magnetic object.

In an embodiment, the at least one further element comprises a core of an axially magnetized permanent ring magnet comprised in the first magnetic object and/or the second magnetic object.

In an embodiment, the at least one further element comprises a cavity for the first permanent magnet and/or the second permanent magnet.

In an embodiment, the first and second forces are of substantially equal magnitude.

According to an aspect there is provided an apparatus comprising: a surface; a base; and at least one of said arrangement for generating vibration according to an electrical input signal.

According to an aspect there is provided a method of manufacturing an arrangement generating vibration according to an electrical input signal, the method comprising: coupling a first permanent magnet with a surface of an apparatus; coupling a second permanent magnet with a base of the apparatus, the first and second permanent magnets arranged to face each other and to cause a first force to the surface; arranging a coil between the first and second permanent magnets, the coil coupled with an input for receiving an electrical input signal, the coil configured to generate a magnetic field according to the electrical input signal in order to displace the surface to generate vibration; the method further comprising: coupling a first magnetic object with the surface such that the first magnetic object at least partially encircles the first permanent magnet; coupling a second magnetic object with the base such that the second magnetic object at least partially encircles the second permanent magnet, wherein at least one of the first and second magnetic objects comprises a permanent magnet, the first and second magnetic objects arranged to face each other and to cause a second force to the surface having an opposite direction compared with the first force.

BRIEF DESCRIPTION OF THE DRAWINGS

In the following the invention will be described in greater detail by means of preferred embodiments with reference to the attached drawings, in which.

DETAILED DESCRIPTION

The following embodiments are exemplifying. Although the specification may refer to "an", "one", or "some" embodiment(s) in several locations of the text, this does not necessarily mean that each reference is made to the same embodiment(s), or that a particular feature only applies to a single embodiment. Single features of different embodiments may also be combined to provide other embodiments.

WO2016079385 is incorporated herein as a reference in its entirety.

Figure 1:
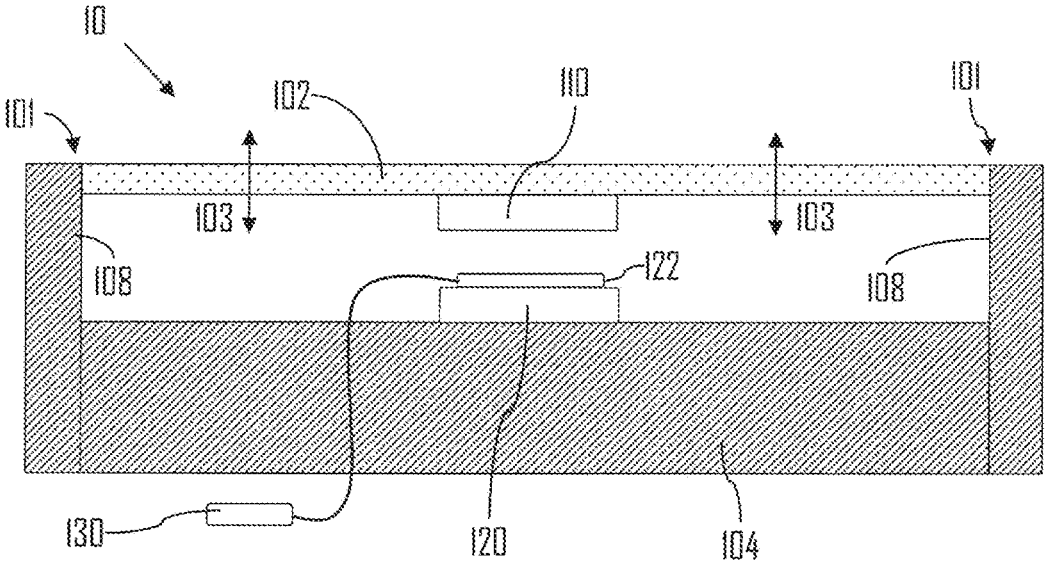
FIG. 1 illustrates a cross sectional view of an arrangement to which embodiments of the invention may be applied.

FIG. 1 shows an arrangement 10 for generating vibration, such as haptic output (e.g. haptic feedback) or audio output (e.g. audio feedback). Referring to FIG. 1, the arrangement 10 comprises: a surface 102 arranged to be mechanically displaced, a first magnet 110 coupled with the surface 102, at least one supporting member 108 for supporting the surface 102, a base 104, a second magnet 120 coupled with the base 104, wherein the second magnet 120 is arranged to face the first magnet 110 as shown in FIG. 1. The arrangement 10 may further comprise a coil 122 arranged between the first and second magnets 110, 120, and an input 130 (e.g. signal port) electrically coupled with the coil 122, wherein an electrical signal is configured to travel between the signal port 130 and the coil 122. A magnetic field between the first magnet 110 and the second magnet 120 causes a force to the surface 102, wherein an entity, comprising the surface 102 and the at least one supporting member 108, comprises at least one elastic element providing a supporting counterforce acting as a counterforce to the force caused by the magnetic field, causing the surface 102 to be in a force equilibrium state, and wherein the electrical signal in the coil 122 is proportional to mechanic displacement of the surface 102 when the force equilibrium state is broken either by the electrical signal in the coil 122 or the mechanic displacement of the surface 102 from a position of the force equilibrium state. That is, when an electrical signal is fed via the input 130 to the coil 122, the force equilibrium may be broken. Hence, the surface 102 may be caused to vibrate (indicated with arrow 103) according to the electrical input signal. It is further noted that the surface 102 may be supported by the at least one supporting member 108, e.g. the surface 102 may be coupled with the at least one supporting member from area(s) 101. For example, the surface 102 may thus be supported with respect to the base 104 (e.g. the member(s) 108 may be comprised in the base 104). For example, the arrangement 10 may be for generating an audio output according to the electrical input signal. Audio output may mean and/or comprise sound that is detectable by human ear, i.e. sound that may be heard by a human. In some examples, it may refer to sound that is detectable by animal(s) and/or audio sensors (e.g. microphone). For example, the audio output may comprise music, speech, sound effects and the like. It is also pointed out that the surface 102 and the base 104 may be parts of an apparatus, such as a mobile phone, television, computer, music player, or some other type of user device. For example, the base 104 may form at least a part of a frame of the apparatus. For example, the surface 102 may be or be comprised in a screen of the apparatus (e.g. electronic apparatus). For example, the provide solution may be applicable to automotive industry (e.g. cars). For example, the surface 102 may comprise car panels such as car interior panel (e.g. door panel, ceiling or roof panel, wall panel, frame panel, or some other part of the car interior. For example, the surface 102 may comprise car display. For example, the surface 102 may be comprised in a wearable device, such as wearable electronic device. For example, the surface 102 may be comprised a portable electronic device, such as a watch or wrist device (e.g. surface 102 may be comprised in a display of such device).

Figure 2:
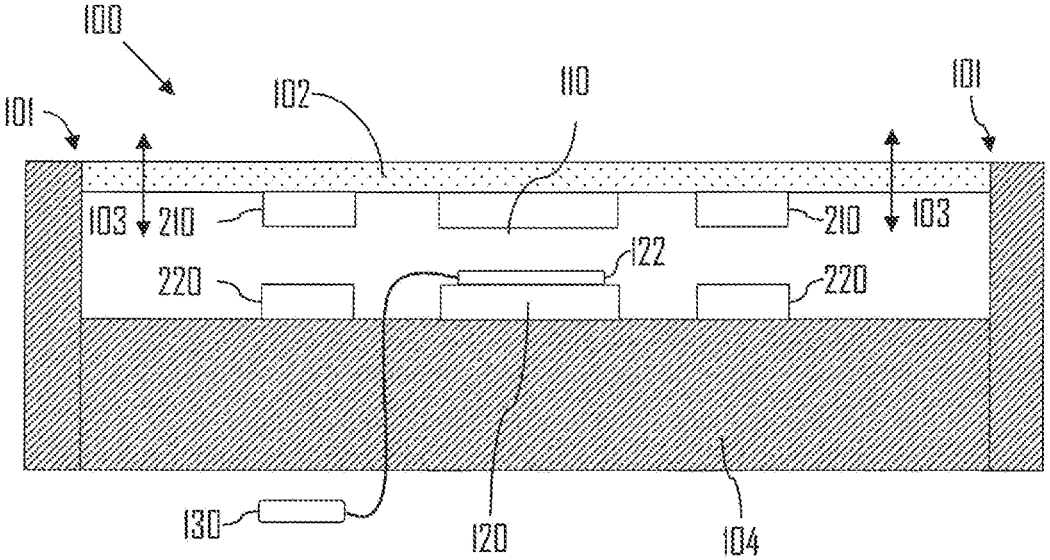
FIG. 2 illustrates a cross sectional view of an embodiment.

There is provided a further solution which may be applicable for the arrangement 10 of FIG. 1. Said further solution is discussed now in more detail. FIG. 2 illustrates an embodiment. Referring to FIG. 2, an arrangement 100 for generating vibration according to an electrical input signal is shown. The arrangement 100 comprises: the first permanent magnet 110 configured to be coupled with the surface 102 of an apparatus; the second permanent magnet 120 configured to be coupled with the base 104 of the apparatus, the first and second permanent magnets 110, 120 configured to be arranged to face each other and to cause a first force to the surface 102; and the coil 122 arranged between the first and second permanent magnets 110, 120 and coupled with the input 130 for receiving an electrical input signal, the coil 122 configured to generate a magnetic field according to the electrical input signal in order to displace the surface 102 to generate vibration (e.g. shown in FIG. 1 with arrows 103). The arrangement 100 further comprises a first magnetic object 210 configured to be coupled with the surface 102, and a second magnetic object 220 configured to be coupled with the base 104. The first and second magnetic objects 210, 220 are configured to be arranged to face each other and to cause a second force to the surface 102 having an opposite direction compared with the first force (i.e. force caused by the first and second permanent magnets 110, 120 to the surface 102). Hence, the second force may further be used to acquire the force equilibrium state discussed with respect to FIG. 1. This may provide additional benefits. For example, the strain on the surface 102 may be reduce as the opposing force may be inflicted to the surface in a more even manner compared with a solution where the counterforce is inflicted from edge areas of the surface 102. Such counterforce may cause bending of the surface 102 which may be reduced by using the objects 210, 220 as described. Another benefit may be that stronger permanent magnets 110, 120 may be used as there is possibility to provide a counterforce to the stronger permanent magnets. It is also pointed out that the bending of the surface 102 may also produce counterforce, and can be used to provide at least some of the counterforce in some embodiments. Similar or same effect can be achieved utilizing the solution described, for example, with reference to FIG. 11, 12, 13, 14, 15, and/or 16.

In an alternative embodiment, the coil 122 is placed between the magnetic objects 210, 220 instead of placement between the permanent magnets 110, 120.

As shown in FIGS. 1 and 2, the permanent magnets 110, 120 may be arranged to be at a distance from each other. Similarly, the objects 210, 220 may be arranged to be at a distance from each other. This may enable the surface 102 to vibrate according to the signal in the coil 122. It is also pointed out that the surface 102 may be at a distance from the base 104 from at least some areas. I.e. the surface 102 is hangably arranged, pre-tensioned and/or otherwise arranged such that it may vibrate.

To further enhance the solution, the placement of the first and second magnetic objects 210, 220 may be such that the first magnetic object 210 at least partially encircles and/or surrounds the first permanent magnet 110, and the second magnetic object 220 at least partially encircles and/or surrounds the second permanent magnet 120. The encircling may be such that the object 210, 220 fully encircles the corresponding magnet or at least extends to opposite sides of the respective magnet (i.e. permanent magnet 110, 120 is placed between at least two portions of the respective magnetic object 210, 220). It is also possible that the magnetic object 210, 220 is made of pieces which at least partially encircle the respective permanent magnet 110, 120, meaning that not all parts of the magnetic objects 210, 220 are necessarily magnetic.

There are different possibilities to achieve the second force (also referred to as counterforce) cause by the magnetic interaction between the first and second magnetic objects 210, 220. In one example at least one of the first and second magnetic objects 210, 220 is a permanent magnet (e.g. one is permanent magnet and other comprises magnetic material or both are permanent magnets).

It is noted that the first magnetic object 210 may be placed at a distance from the first permanent magnet 110 as shown in FIG. 2. Similarly, there may be a certain gap between second magnetic object 220 and the second permanent magnet 120. Using the gap therebetween may reduce the interaction of magnetic forces between the second permanent magnet 120 and the first magnetic object 210, for example. Similarly, the gap may reduce the interaction of magnetic forces between the first permanent magnet 110 and the second magnetic object 220. Therefore, using the gap may further improve the provided solution. The distance or gap between the first magnetic object 210 and the first permanent magnet 110 and/or between the second magnetic object 220 and the second permanent magnet 120 may be, for example, at least 1 millimetre (mm), 5 mm, 1 centimetre (cm), 2 cm, 3 cm, 4 cm, 5 cm, 10 cm or more. The gap may refer to air gap or some other gas, or may comprise some substantially non-magnetic material. As discussed later, magnetic material may also be used between the magnets and magnetic objects.

It is noted that the coupling of a magnet or magnetic object with the surface 102 or the base 104 may refer to fixing or attaching said magnet or magnetic object to the surface 102 or the base 104. Such fixing may be achieved using, for example, glue and/or screws. In some examples, the different magnet(s) and/or magnetic object(s) may be printed on the surface 102 and/or the base 104. Hence, the coupling may also comprise printing (e.g. electronics printing). Further, the arrangement of the coil 122 between the permanent magnets 110, 120 may comprise coupling (e.g. fixing or attaching) the coil 122 with the second permanent magnet 120 or with the first permanent magnet 110. However, it may also be possible to use separate elements to arrange the coil 122 between the permanent magnets 110, 120 such that it does not physically touch neither of said permanent magnets 110, 120. For example, said element(s) may be attached to the base 104 or some other part of the arrangement, and reach to the area between the permanent magnets 110, 120. Similar, attachment with respect to possibly used further coil (e.g. coil 722) may be used.

Also, the surface 102 may be supported with respect to the base 104 using a plurality of different solutions. For example, one or more elastic and/or flexible elements may be used to support the surface 102. In one example, the one or more elastic and/or flexible elements comprise spring(s) disposed between the surface 102 and the base 104. However, these may not necessarily be needed as the counterforce may be partially or entirely achieved using the magnetic objects 210, 220. Hence, these one or more elastic and/or flexible elements are not discussed in further detail. It may suffice that the surface 102 may be supported from at least one area 101 with respect to the base 104 (e.g. edge area 101 of the surface 102, such as a screen). The supporting on the area(s) 101 may be at least partially elastic and/or comprise clearance such that the surface 102 may move also from the edge areas with respect to the base 104 according to the electronic signal inputted via the input 130 to the coil 122.

According to an embodiment, the provided arrangement comprises one or more elastic elements (e.g. springs) disposed between the elements 310 and 320 (e.g. fixed to both elements to provide the counterforce). Similarly, in cases where only two magnets are used (e.g. magnets 110, 120) the springs may be arranged between bases coupled (e.g. fixed) with the magnets. So, for example, magnet 110 may comprise or be coupled with a base. So, for example, magnet 120 may comprise or be coupled with a base. Hence, the springs or similar elements may be connected to said bases. So, as described, the arrangements does not initially necessarily require the surface 102 and the base 104, but may be arranged in such system or apparatus comprising the surface 102 and the base 104 with minimum effort as the arrangement may already be configured to be in equilibrium state.

It is also pointed out that the surface 102 may be rigid (i.e. bends very little or not at all, e.g. inflexible). The surface 102 may comprise, for example, a plane. The surface 102 may comprise, for example, metal, wood, glass, and/or plastics. In an embodiment, the thickness of the surface 102 is at least 1 mm, 2 mm, 3 mm, or 5 mm. In an embodiment, the thickness of the surface 102 is at least 1 cm. In an embodiment, the thickness of the surface 102 is at least 2 cm. In an embodiment, the thickness of the surface 102 is at least 5 cm.

Figure 3:
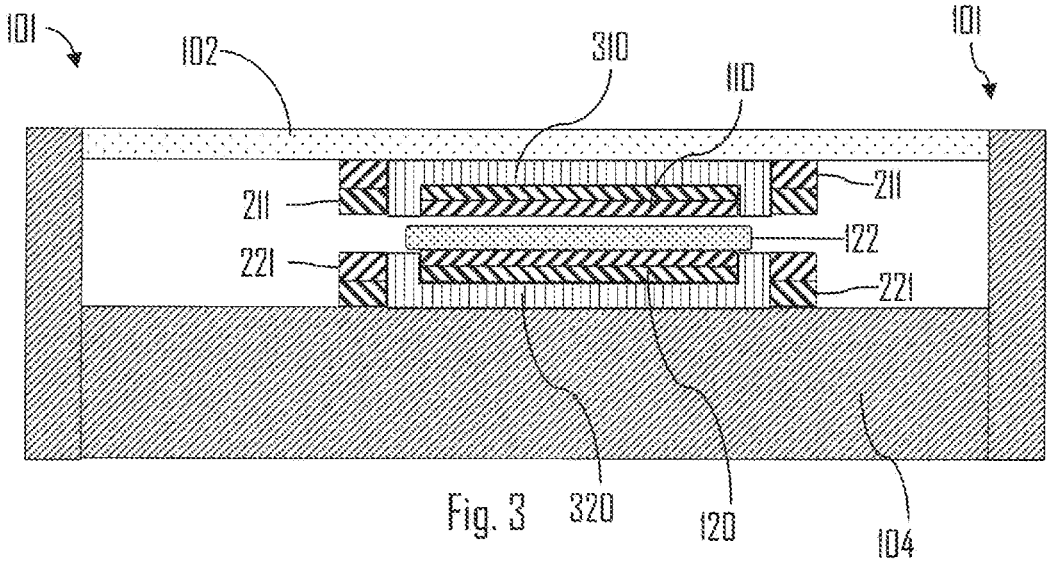
FIG. 3 illustrates a cross sectional view of an embodiment.

FIG. 3 shows the arrangement 100 according to an embodiment. Referring to FIG. 3, the first and second magnetic objects 210, 220 each comprise a permanent magnet 211, 221. The number of permanent magnets is not necessarily limited to two, but two may suffice at least in some examples (e.g. ring magnets). In the example of FIG. 3, the first and second permanent magnets 110, 120 cause a force that pushes the magnets 110, 120 away from each other). However, the first and second magnetic objects 210, 220 (or more precisely their permanent magnets 211, 221) are placed such that they pull each other. Hence, the overall force to the surface 102 may be sum of said two pushing and pulling forces. Naturally, the forces may be arranged other way around (i.e. permanent magnets 110, 120 pull each other and permanent magnets 211, 221 push each other).

Previously, it was discussed that there may be a gap between the magnetic object 210 and the permanent magnet 110, and similarly, between the magnetic object 220 and the permanent magnet 120. In an embodiment, the arrangement 100 further comprises at least one further element 310, 320 comprising magnetic material. For example, a first further element 310 may be arranged between the first permanent magnet 110 and between the permanent magnet 211 of the first magnetic object 210. For example, a second further element 320 may be arranged between the second permanent magnet 120 and the permanent magnet 221 of the second magnetic object 220. The at least one further element 310, 320 may act as a buffer between the magnets 211, 110, and between the magnets 221, 120. Buffer here may mean that the magnetic interaction reduced using the gap described earlier may be further reduced using the at least one further element 310, 320 between the permanent magnets. Hence, there may be no need for the gap(s), and thus smaller devices may be achieved. However, in addition to the at least one further element 310, 320, the gap or gaps between the magnets may be used. For example, the at least one further element 310, 320 comprises and/or is made of ferromagnetic and/or ferrimagnetic material(s), such as iron.

In an embodiment, the first magnetic object 210 is coupled (e.g. attached or fixed) to the first element 310.

In an embodiment, the second magnetic object 220 is coupled (e.g. attached or fixed) to the second element 320.

In an embodiment, the first permanent magnet 110 is coupled (e.g. attached or fixed) to the first element 310.

In an embodiment, the second permanent magnet 120 is coupled (e.g. attached or fixed) to the second element 320.

In an embodiment, the at least one further element 310, 320 comprises a core of an axially magnetized permanent ring magnet comprised in the first magnetic object 210 and/or the second magnetic object 220. For example, the first element 310 may form the core of an axially magnetized permanent ring magnet 211. For example, the second element 310 may form the core of an axially magnetized permanent ring magnet 221.

In an embodiment, the at least one further element 310, 320 comprises a cavity for the first permanent magnet 110 and/or the second permanent magnet 120. This may be shown in FIG. 3 in which the first permanent magnet 110 may be placed in a cavity of the first element 310 forming the core of the ring magnet 211. Similarly, the second permanent magnet 120 may be placed in a cavity of the second element 320 forming the core of the ring magnet 221. The coil 122 may reach to the area of the at least one further element 310, 320 (e.g. between elements 310, 320). However, this may not be necessary.

Figure 4A:
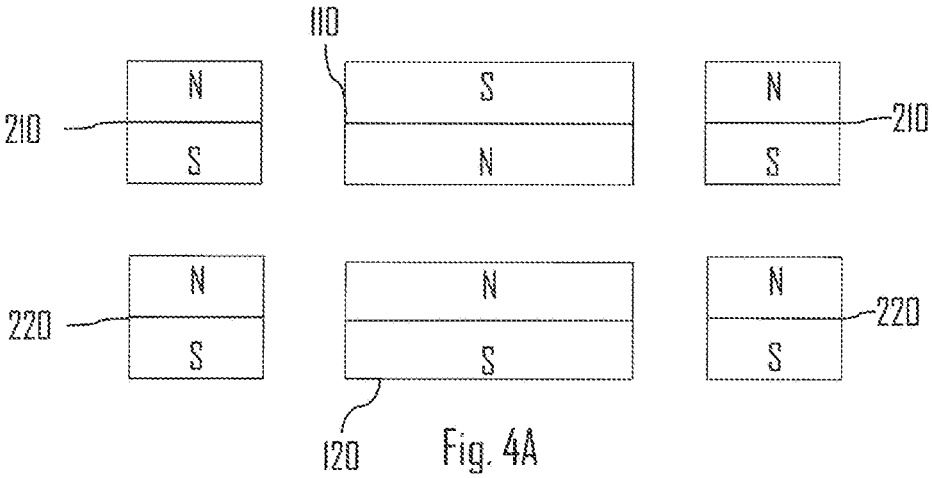
FIGS. 4A and 4B illustrate some embodiments.
Figure 4B:
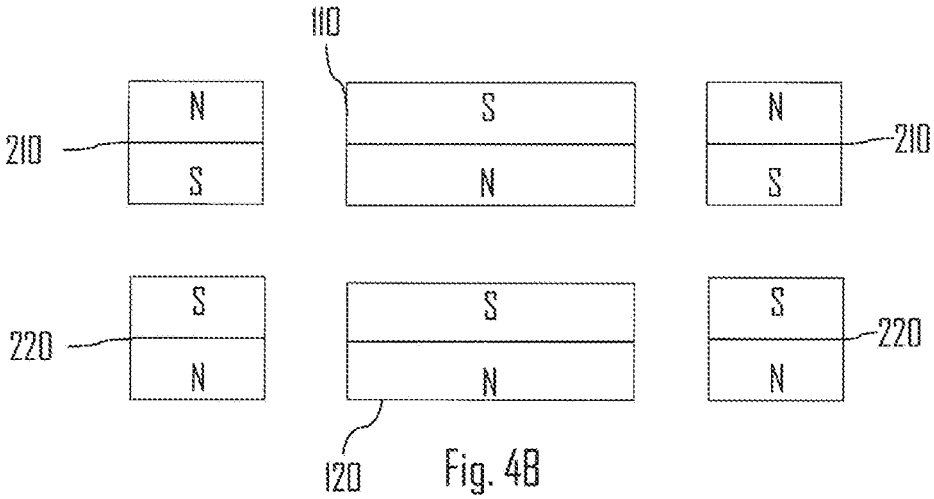

FIGS. 4A and 4B show some examples of different arrangements of the permanent magnets and/or magnetic objects. For example, with reference to FIG. 4A, if the north poles of permanent magnets 110, 120 are placed to face each other, the magnetic objects 210, 220 may be arranged such that other provides a south pole and the other provides a north pole that are facing each other. Hence, the first force and the second force may be to opposite directions. With reference to FIG. 4B, the second permanent magnet 120 is flipped and thus there is a pulling force between the magnets 110, 120. Hence, it may be necessary to arrange at least one of the magnetic objects 210, 220 to achieve the opposing force therebetween.

Figure 5A:
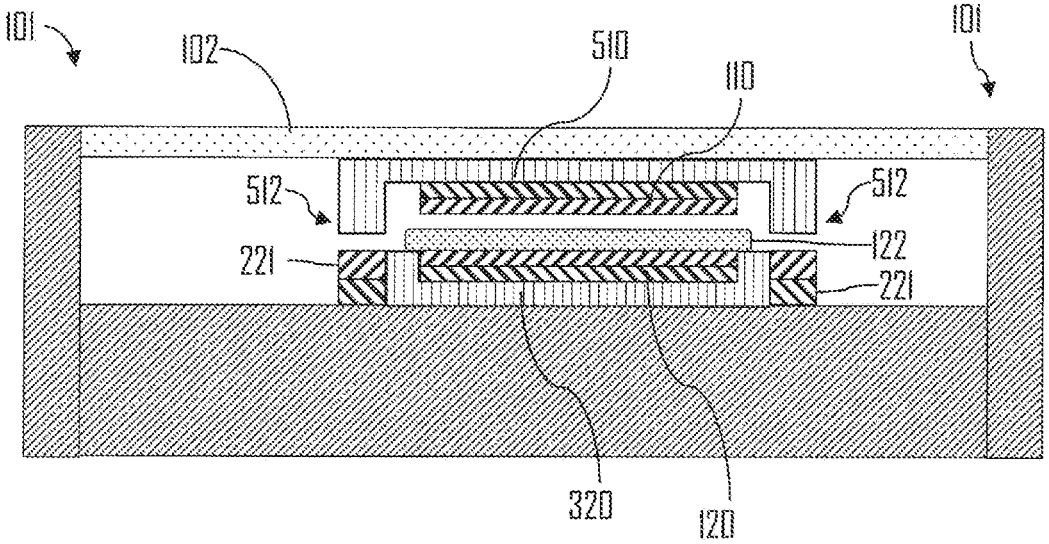
FIGS. 5A and 5B illustrate a cross sectional view of some embodiments.
Figure 5B:
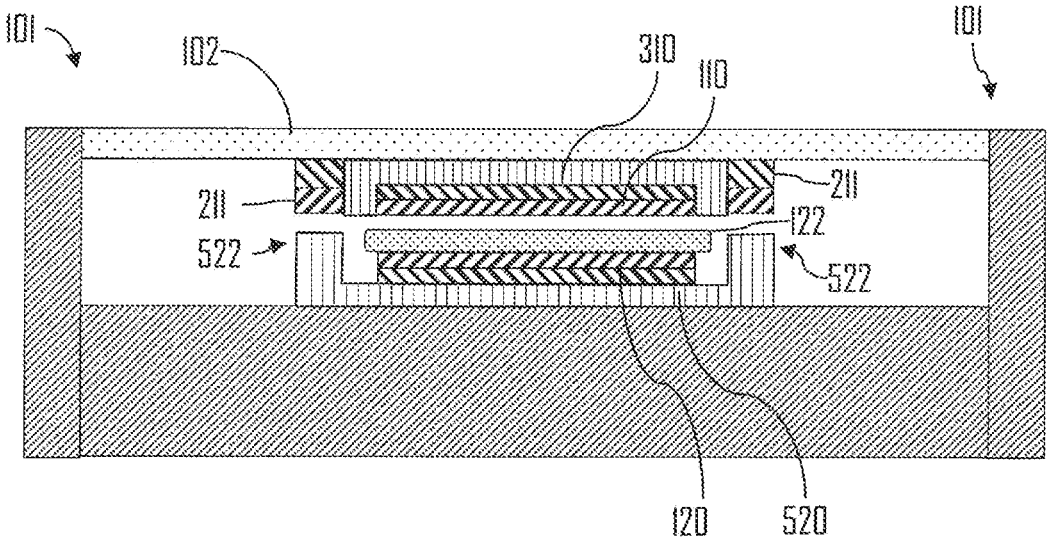

Use of permanent magnets 211, 221 may not be necessary in all cases. Examples of such configurations may be shown in FIGS. 5A and 5B illustrating some embodiments. Referring to FIGS. 5A and 5B, the first magnetic object 210 or the second magnetic object 220 may comprise an element 510 or 520. Said element(s) 510, 520 may be made of and/or magnetic material, such as ferromagnetic and/or ferrimagnetic material. Hence, if the other one of the first and second magnetic objects 210, 220 comprises a permanent magnet, the element 510, 520 may be used to provide the counterforce similarly as in the situation where both magnetic objects 210, 220 comprise permanent magnets.

According to an embodiment (referring to FIG. 5A), a first pole of the first permanent magnet 110 faces the second permanent magnet 120, wherein a second pole of the first permanent magnet 110 is fixed to the first magnetic object 210 to magnetize the first magnetic object 210 (or more particularly the element 510) facing the second magnetic object 220. In such case the second magnetic object 220 may comprise a permanent magnet (e.g. permanent magnet 221 as shown in FIG. 5A, for example.

According to an embodiment (referring to FIG. 5B), a first pole of the second permanent magnet 120 is arranged to face the first permanent magnet 110, wherein a second pole of the second permanent magnet 120 is fixed to the second magnetic object 220 to magnetize the second magnetic object 220 (or more particularly the element 520) facing the first magnetic object 210. In such case the first magnetic object 210 may comprise a permanent magnet (e.g. permanent magnet 211 as shown in FIG. 5B), for example. For example, first pole may be north and second pole may be south. Other way around, first pole may be south and second pole may be north. In the Figures (e.g. FIGS. 5A and 5B) one magnetic pole (e.g. first pole) may be indicated with a pattern fill comprising backslashes and the other magnetic pole (e.g. second pole) is indicated with a pattern fill comprising slashes or solidus.

As shown in FIGS. 5A and 5B, if the magnetic object 210, 220 is magnetized using the permanent magnet 110, 120, said magnetic object 210, 220 may be referred to as a magnetized element 510, 520 (i.e. magnetic object 210 is element 510 and magnetic object 220 is element 520). Accordingly, areas 512, 522 may be magnetized such that they enable to provide the counterforce. For example with reference to FIG. 5A, if same poles of first and second permanent magnets 110, 120 are facing each other, the magnetized element 510 is drawn to the magnet 221 from the area 512 as the area 512 may be magnetized with the opposing pole (i.e. opposing to the pole facing the second permanent magnet 120) of the first permanent magnet 110. Similarly, the area(s) 522 of FIG. 5B may be magnetized according to the same principles. So, for example, in FIG. 5A, areas 512 may be magnetized such that they represent second pole (i.e. backslash filled portions).

It is further noted that the element 510, 520 may comprise a cavity for the permanent magnet 110, 120. It is further noted that said cavity may be such that the elongating area or areas 512, 522 are not in direct contact with the permanent magnet 110, 120 (as shown in FIG. 5B). Hence, the element 510, 520 and the permanent magnet 110, 120 may be arranged such that only one pole of said permanent magnet 110, 120 is in direct contact with the element 510, 520, and thus the element 510, 520 may be magnetized with the needed pole (i.e. the same pole which is in contact with the permanent magnet 110, 120).

Figure 6A:
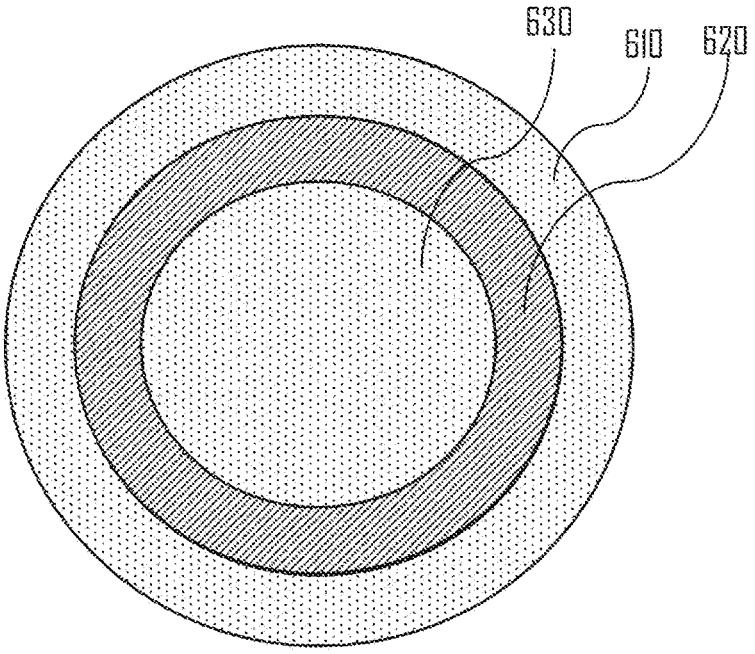
FIGS. 6A and 6B illustrate a top view of an arrangement according some embodiments.
Figure 6B:
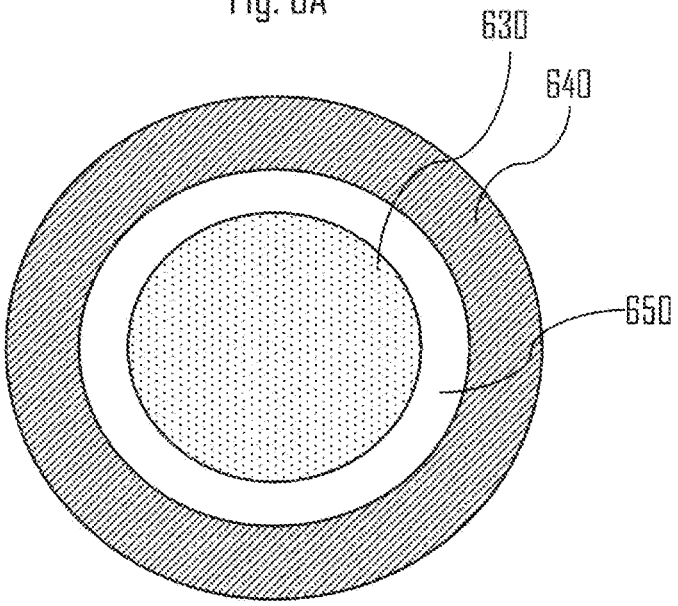

FIGS. 6A and 6B illustrate birds-eye view of the arrangement 100 according to some embodiments. Referring to FIG. 6A, a magnetic object 610 encircles a permanent magnet 630. The magnetic object 610 may refer to one or both the first magnetic object 210 and the second magnetic object 220. Correspondingly, the permanent magnet 630 may refer to one or both the first permanent magnet 110 and the second permanent magnet 120. It needs to be noted that the encircling magnetic object 610 may be fully or partially magnetic as discussed above.

In an embodiment, the magnetic object 610 comprises an axially magnetized permanent ring magnet. That is, the ring magnet may encircle the permanent magnet 630.

In an embodiment, with reference to FIG. 6A, a further magnetic element 620 may be placed between the object 610 and the permanent magnet 630. Said further element 620 may refer to one or both the element 310 and the element 320 of FIG. 3. According to one embodiment, the element 620 forms a core of the axially magnetized permanent ring magnet (i.e. comprised or forming element 610). The element 620 may further comprise a cavity or a slot for the permanent magnet 630. Thus, the permanent magnet 630 may be embedded into the element 620, and the element 620 may be embedded into the ring magnet (i.e. comprised or forming element 610).

Referring to FIG. 6B, situation illustrated and discussed with respect to FIGS. 5A and 5B may be shown. That is, the permanent magnet 630 may be encircled by an element 640 (e.g. comprise ferromagnetic material) which may be magnetized by said permanent magnet 630. As described, there may be a gap 650 between the permanent magnet 630 and the element 640, the gap 650 enabling the permanent magnet 630 to be in contact with the element 640 via only one pole of the permanent magnet 630. Said element 640 may refer to one or both the element 510 and element 520 of FIGS. 5A and 5B.

In an embodiment, the permanent magnet 630 is a disc magnet, i.e. axially magnetized permanent disc magnet 630.

For example, the element 620 may be a cylinder with a cylindrical cavity, wherein the disc magnet 630 may be placed in said cylindrical cavity. Said cavity may as well be rectangular, wherein the magnet 630 may thus be rectangular. The object 610 may surround the element 620. In an embodiment, the object 610 is a cylinder (or of some other form) with a cylindrical cavity (or of some other form), wherein the element 620 may be placed in a cavity formed by said object 610.

Figure 7A:
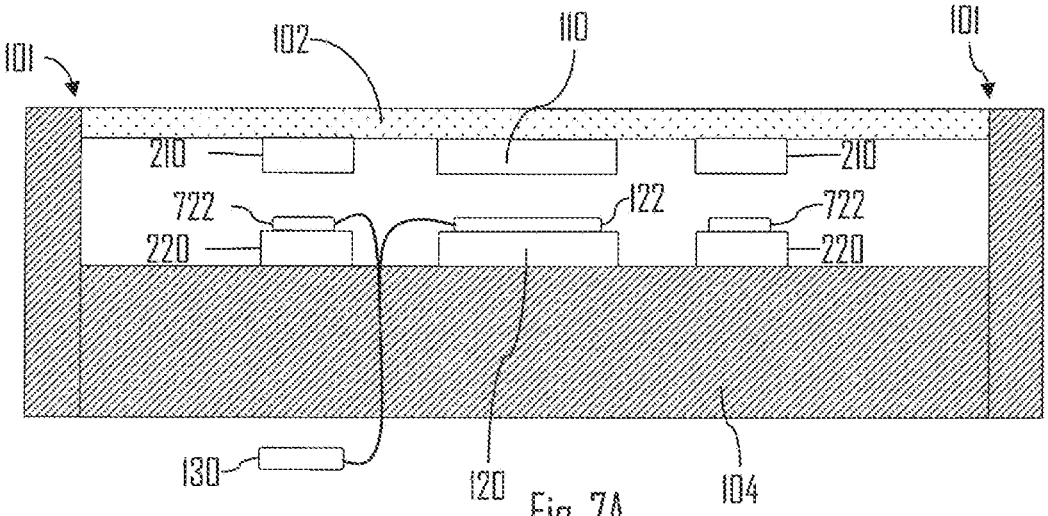
FIGS. 7A, 7B and 7C illustrate some embodiments.
Figure 7B:
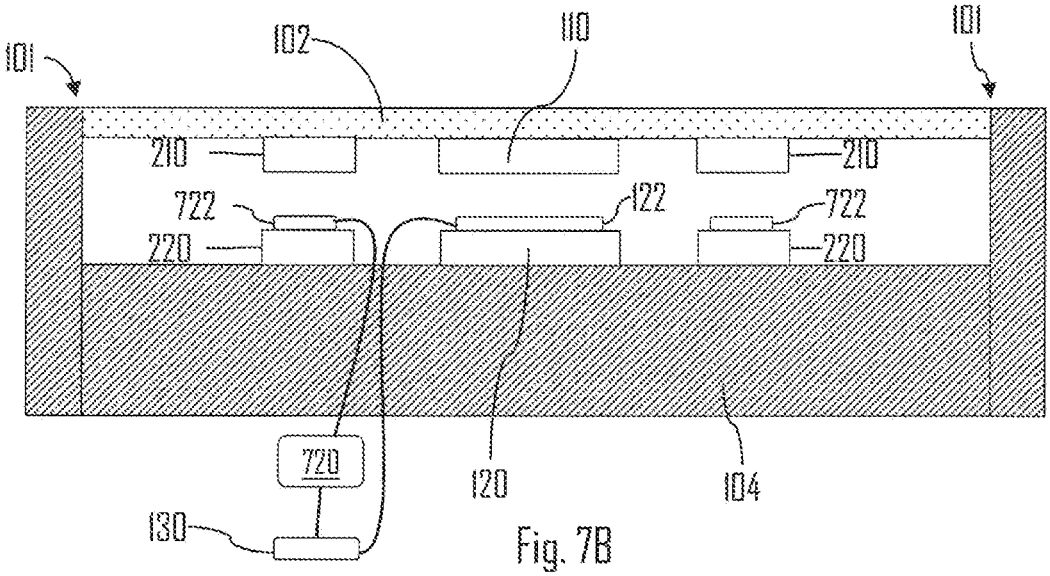
Figure 7C:
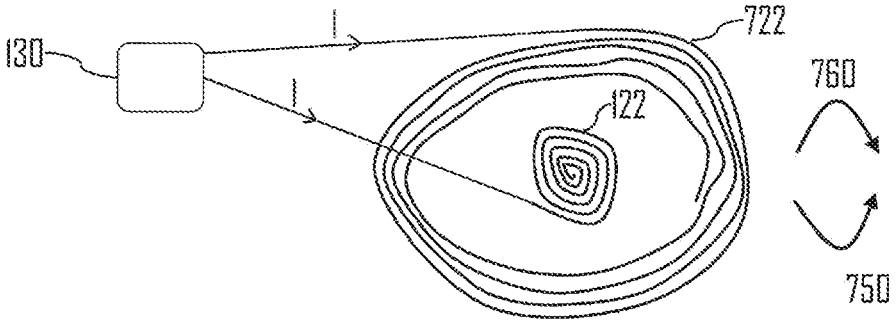

FIGS. 7A to 7C illustrate some embodiments. According to an embodiment, the arrangement 100 further comprises a second coil 722 arranged between the first and second magnetic objects 210, 220 and configured to generate a second magnetic field according to an electrical input signal. The coil 122 (now referred to as a first coil 122) and the second coil 722 may be coupled with the same input 130 or with different inputs. Hence, the arrangement 100 may be used in a plurality of different ways to generate different magnetic fields in order to displace the surface 102 to generate vibration. If there is no input via the input 130 and/or some other input, the surface 102 may be in a force equilibrium state. However, when input is provided to the coil(s) 122, 722, the equilibrium state may be broken. The second coil 722 may be coupled with the second magnetic object 220. However, it may be coupled to the first magnetic object 210 or otherwise arranged between said objects 210, 220.

Now, according to an embodiment, the coils 122, 722 are connected to the same input 130 (e.g. FIG. 7A). That is, same, identical or similar electrical input signal may be simultaneously inputted to both coils 122, 722. According to an alternative embodiment, a different electrical signals may be inputted to both coils 122, 722 and/or the input signal(s) may be inputted at different time periods.

According to an embodiment, arrangement 100, the coils 122, 722 and/or the input 130 is arranged such that when the magnetic fields generated by the coils 122, 722 both cause a force to the surface 102 that is substantially to the same direction (e.g. towards the base 104 or outwards from the base 104). There may be plurality of different ways to achieve this. However, there may be at least two solutions which may be used.

Referring to FIG. 7B, the arrangement 100 further comprises a phase shifter 720 for shifting a phase of an electrical input signal such that a phase of the electrical input signal inputted into the first coil 122 is substantially 180 degrees different compared with a phase of an electrical input signal inputted into the second coil 722. That is, if same or similar signal is used as an input, before the signal is inputted in the coils 122, 722, the signal may be processed or altered (e.g. analogic and/or digital processing) such that the inputted signals to the coils are in antiphase with respect to each other. One example of such processing may be delaying the phase of the input signal to the second coil 722.

Referring to FIG. 7C, a winding of the first coil 122 may be opposite to a winding of the second coil 722. E.g. if the winding of the first coil 122 is to direction 750, the winding of the second coil 722 may be to opposite direction 760. Hence, if an input signal having the same phase is inputted in to both coils 122, 722, the coils may provide magnetic fields which are (at least) to substantially different directions, i.e. same or identical input signal is configured to be inputted to both coils 122, 722. It is noted that the throughout the description, phrases like input signal or electrical input signal is used. Such may refer to an electrical input signal which has an alternating current (AC) component. Said signal may or may not have a direct current (DC) component. However, as generally known, the alternating current in a coil may cause the magnetic field. This is generally referred to as electromagnet functionality.

The coil(s) 122, 722 may be placed between the magnets 110, 120 and the magnetic objects 210, 220 such that the main force component caused, by the input signal(s), to the surface is substantially orthogonally towards or away from the base. E.g. the winding may be placed on the magnet 120 or object 220 as shown in FIG. 7C illustrating top view of the coils 122, 722.

In an embodiment, the coil(s) 122, 722 have a core, such as an iron core. Said core may be orthogonal to the magnet 120 or the object 220 when the coil 122 or the second coil 722 is placed on said magnet 120 or on said object 220.

In an embodiment, the first and second forces are of substantially equal magnitude. That is, the magnetic objects 210, 220 and the permanent magnets 110, 120 may be arranged, dimensioned and configured such that the forces are substantially equal. Hence, the strain to the surface 102 may further be reduced when the surface 102 is in the force equilibrium state. If the forces are unequal magnitude, the equilibrium state may be achieved using elastic elements (e.g. 108) and/or relying on the spring force caused by the bending surface 102.

In an embodiment, the coil 722 is attached to a permanent magnet of the second magnetic object 220 or a permanent magnet of the first magnetic object 210. For example, the coil 722 may be used in embodiments utilizing permanent magnet at both the first and second magnetic objects 210, 220 (e.g. FIG. 3) and embodiments utilizing one permanent magnet and one magnetized element (e.g. FIGS. 5A and 5B).

It is further noted that although not shown in FIG. 7C, the coils 122, 722 may be connected from other ends to ground potential such that a closed electrical circuit or circuits may be formed. This is believed to be well within capability of a skilled person and thus not explained in further detail.

Figure 8:
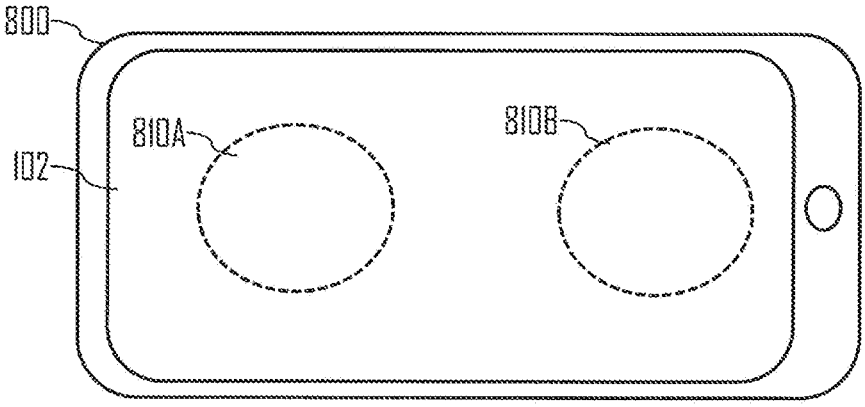
FIG. 8 illustrates an embodiment.

FIG. 8 illustrates an embodiment. Referring to Figure, an apparatus 800 is shown. The apparatus 800 may comprise the surface 102 (e.g. a display of the apparatus 800) and the base 104 (not shown in FIG. 8). Furthermore, the apparatus 800 may comprise at least one arrangement 100 as described above and/or below. The arrangement 100 is illustrated as arrangement 810A and 810B in FIG. 8. Using the arrangement(s) 100 in the apparatus 800 may remove the need to use an additional vibration element and/or speaker. Hence, there may be more room in the device for display, for example. Such may be a beneficial feature, for example, for mobile phones, televisions and the like.

Figure 9:
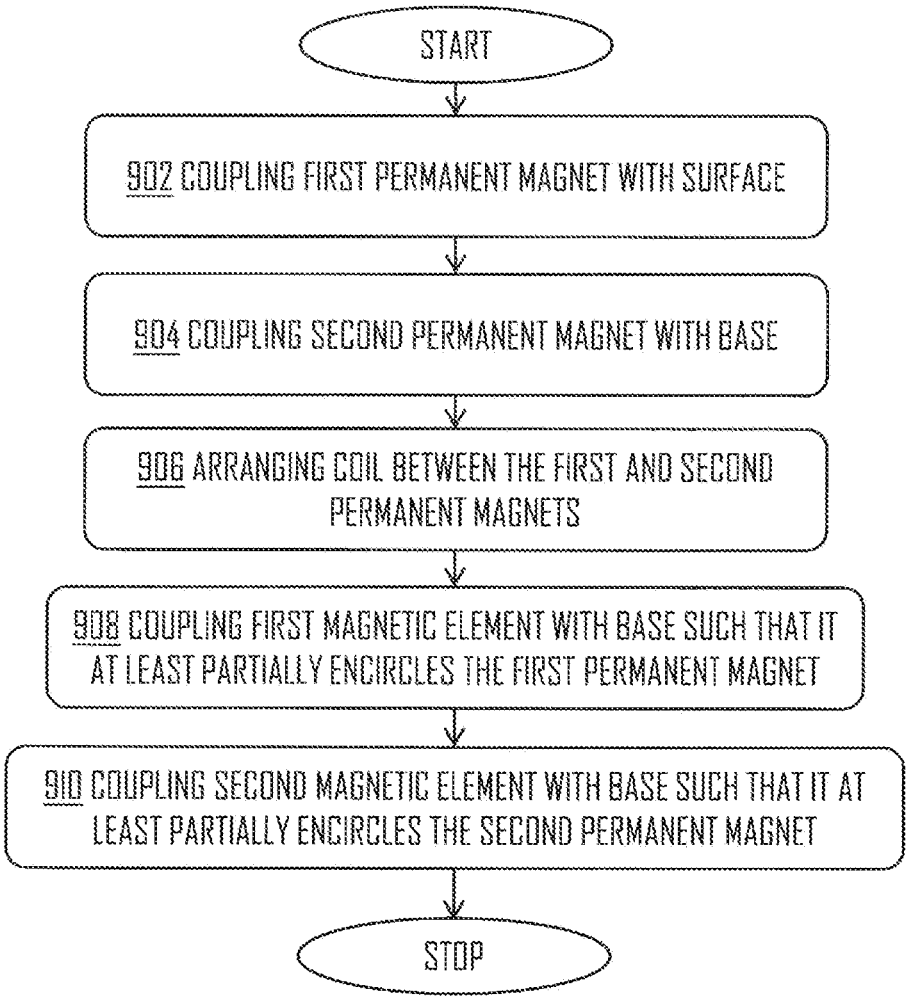
FIG. 9 illustrates a flow diagram according to an embodiment.

FIG. 9 illustrates a flow diagram of a method of manufacturing an arrangement 100 generating vibration according to an electrical input signal, the method comprising: coupling a first permanent magnet with a surface of an apparatus (block 902); coupling a second permanent magnet with a base of the apparatus, the first and second permanent magnets arranged to face each other and to cause a first force to the surface (block 904); arranging a coil between the first and second permanent magnets, the coil coupled with an input for receiving an electrical input signal, the coil configured to generate a magnetic field according to the electrical input signal in order to displace the surface to generate vibration (block 906); coupling a first magnetic object with the surface such that the first magnetic object at least partially encircles the first permanent magnet (block 908); coupling a second magnetic object with the base such that the second magnetic object at least partially encircles the second permanent magnet (block 910), wherein at least one of the first and second magnetic objects comprises a permanent magnet, the first and second magnetic objects arranged to face each other and to cause a second force to the surface having an opposite direction compared with the first force.

Figure 10:
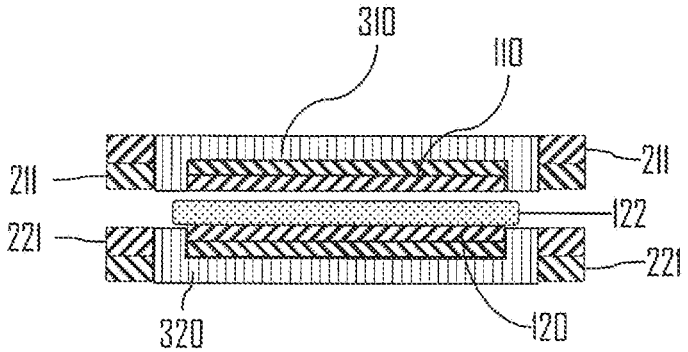
FIG. 10 illustrates an arrangement according to an embodiment.

FIG. 10 illustrates the arrangement 100 according to an embodiment. As shown in the Figure, the arrangement 100 does not necessarily comprise the surface 102 and the base 104. However, the arrangement 100 may be arranged such that the arrangement 100 is attachable to the surface 102 and to the base 104. Although in FIG. 10 four permanent magnets are shown (i.e. 110, 120, 211, 221), the solution may be similarly applicable to solutions utilizing less permanent magnets (e.g. FIGS. 5A and 5B). For example, the magnets 120 and 221 may be attached to each other via the element 320, and the coil 122 may attached to the formed first entity. A second entity may be formed by attaching the magnets 211 and 110 to each other via the element 310. The second entity may then be attached to the surface 102 and the first entity to the base 104, for example. In some cases, the attachment may be other way around (i.e. first entity may be attached to the surface 102. It is also possible that the coil 722 is used in the embodiment of FIG. 10 (i.e. examples of FIGS. 7A to 7C). Also, the springs or some other elastic elements (if used at all) may be arranged directly between the first and second entities (e.g. attached between said entities). Hence, the assembly comprising the first and second entities may be easily attached to a surface and a base of an apparatus to obtain a vibrating (e.g. sound generating apparatus).

As used in this application, ferromagnetic materials may comprise at least one of cobalt, iron, nickel, gadolinium, dysprosium, permalloy, awaruite, wairakite, and magnetite. In some embodiments, the ferromagnetic materials comprise two or more of said materials. For example, the permanent magnets described above may be made of and/or comprise the described materials.

In an embodiment, the first magnet 110 and/or the second magnet 120 are made and/or comprise neodymium and/or ferrite. In such case, the $kJ/m^3$ value of the first and/or second magnets 110, 120 may be between 250-400 $kJ/m^3$, for example. Similarly, the other permanent magnets described above may comprise said material(s).

According to an aspect, there is provided an arrangement 100 for generating vibration according to an electrical input signal, the arrangement comprising: a first permanent magnet arrangement comprising a first permanent magnet 110; a frame 1110 comprising magnetic material; a second permanent magnet 120 configured to be arranged between the first permanent magnet 110 and the frame 1110 and to be coupled with the frame 1110, one or more portion of the frame 1110 extending at least in one direction over an edge area of the second permanent magnet 120, the second permanent magnet 120 further configured to face, at a distance, the first permanent magnet 110 such that a magnetic interaction between the first permanent magnet 110 and the second permanent magnet 120 causes a first force to a surface 102 of an apparatus, wherein the frame 1110 is configured to be magnetized by the second permanent magnet 120 in order to cause magnetic interaction between said one or more portion of the frame 1110 and the first permanent magnet arrangement in order to cause a second force to the surface 1110 having an opposite direction compared with the first force; and a coil 122 coupled with an input for receiving an electrical input signal, the coil configured to generate a magnetic field according to the electrical input signal in order to displace the surface to generate vibration.

As described, the one or more portions of the frame 1110 may extend at least in one direction over an edge area of the second permanent magnet 120. So, for example, if the second permanent magnet 120 is situated on the frame 1110, the surface area of the surface of the frame 1110 that is placed against the second permanent magnet 120 may be greater than the surface area of the surface of the second permanent magnet 120 that is placed against the frame 1110, i.e. extend over the edge of the permanent magnet 120 at least in one direction. Hence, for example, the one or more parts of the frame 1110 may be visible in the top view of FIG. 15. The frame 1110 may also be, for example, circular or of some other shape.

FIGS. 11, 12, 13, 14, 15, and 16 illustrate some embodiments. The frame 1110 may be or be comprised in magnetic object 210 or 220, or elements 310, 320, for example. Hence, the frame may be similar as the magnetized elements 310, 320, for example. However, according to an embodiment, the frame 1110 (and also the second frame 1120 if such is used, i.e. 1120 may not be necessary, but may be useful) is not a magnet or permanent magnet, but an element that comprises magnetic material that may be magnetized by using a permanent magnet (e.g. magnet 120), for example. For example, the second permanent magnet 120 may be physically coupled with the frame 1110 to magnetize the frame 1110.

Figure 11:
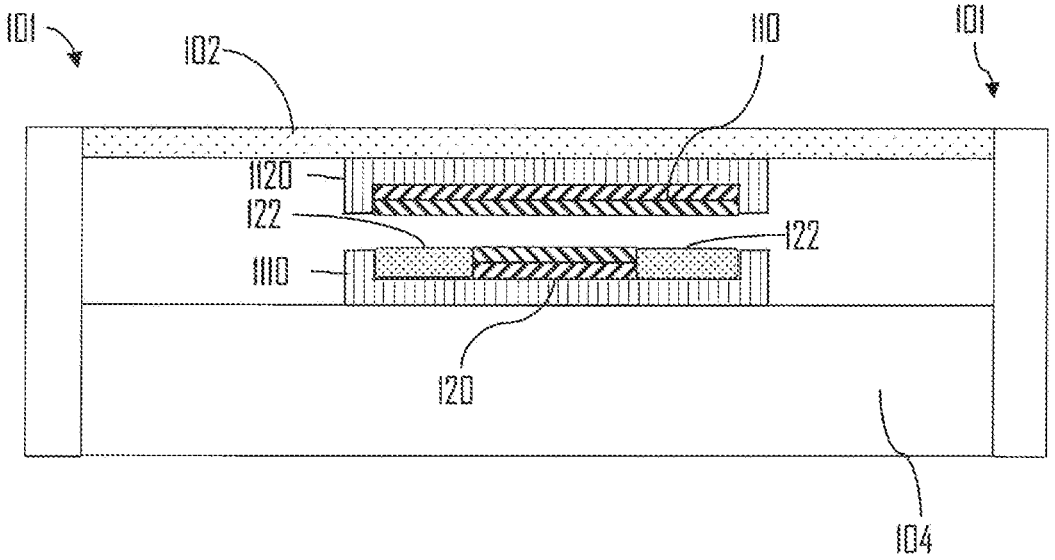
FIGS. 11, 12, 13, 14, 15 and 16 illustrate some embodiments.
Figure 12:
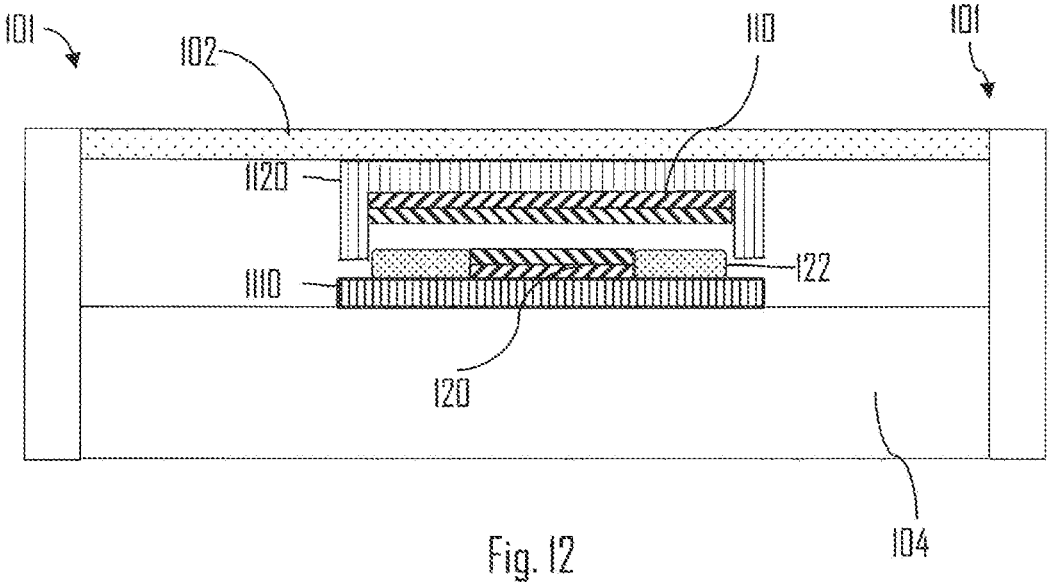
Figure 13:
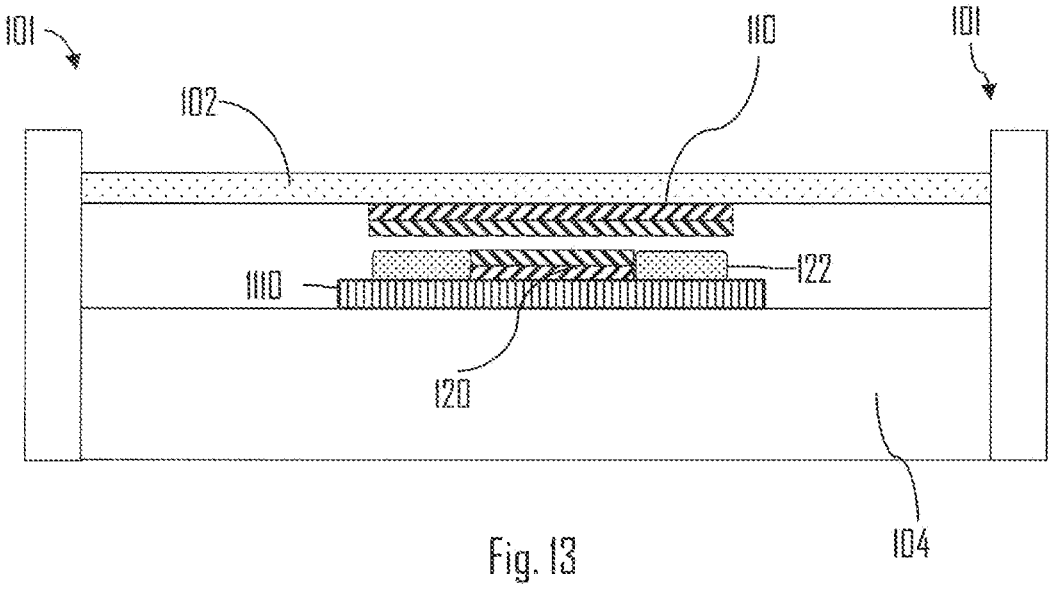

FIGS. 11, 12, and 13 show some embodiments in which the coil 122 is configured to be arranged to encircle the second permanent magnet 120. I.e. the coil 122 is not necessarily between the permanent magnets 110, 120. However, such solution may also be utilized. By encircling the permanent magnet 120 with the coil 122 may provide the benefit of reducing space between the magnets 110, 120, for example. Hence, the first force may be increased, thus possibly providing more efficient solutions. In an embodiment, the coil 122 is configured to be looped around the second permanent magnet. Placing the coil 122 around the permanent magnet 120 or around the first permanent magnet 110 may also be used in other solutions described above.

According to an embodiment, the first permanent magnet arrangement is coupled with the surface 102 and the frame 1110 is coupled with the base 104 of the apparatus. However, this may be other way around. I.e. frame 1110 may be coupled with the surface 102 and the first permanent magnet arrangement with the base 104.

As shown in FIGS. 11, 12, and 13, the shape of the frame 1110 may differ. For example, it may simply be a plane or plate as shown in FIGS. 12 and 13, or provide a cavity for the second permanent magnet 120 and/or the coil 122 as shown in FIG. 11. In both cases, the second force may be caused by magnetic interaction between the first permanent magnet 110 and the frame 1110. I.e. this may happen on areas which are not covered by the second permanent magnets 120. For example, the magnetic interaction may happen via the coil 122 even though no input signal is provided into the coil 122. For example, the parts of the frame 1110 extending over the edge of the second permanent magnet 120 may be magnetized with same polarity as the pole of the second permanent magnet 120 that is attached to the frame 1110.

According to an embodiment, the coil 122 is situated between said one or more portion of the frame 1110 that extends over the edge area of the second permanent magnet 120 at least in one direction and the first permanent magnet arrangement. This can be seen, for example, in FIGS. 11, 12, and 13.

In an embodiment, same polarities of the first and second permanent magnets 110, 120 are arranged to face each other. So, for example, north or south polarities may face each other, thus generating force that pushes the surface 102 away from the base 104. So, for example, if south poles are arranged to face each other, the second permanent magnet 120 magnetizes the frame 1110 with north polarity. Thus, magnetic interaction between said one or more portions of the frame 1110 and the first permanent magnet arrangement may cause pulling force (i.e. surface is pulled towards the base 104). This, as explained, may provide balancing force to the first force. However, the first and second forces are not necessarily of equal magnitude. In an embodiment, the first and second forces are substantially of equal magnitude.

Still referring to FIGS. 11, 12, and 13, in an embodiment, a surface area of a surface of the first permanent magnet 110 that faces the second permanent magnet 120 is greater than a surface area of a surface of the second permanent magnet 120 that faces the first permanent magnet 110. Further examples of these may be seen in FIGS. 15 and 16 in which circular magnets 110, 120 are used. However, it is equally possible to use magnets of some other shape. Using this approach, enables the second force to be caused by the interaction between the first permanent magnet 110 and the frame 1110, as they may be directly facing each other at least on some portions. The coil 122 may be arranged between the first permanent magnet 110 and the frame 1110, which may further enhance the coil's 122 ability to cause the surface 102 to vibrate.

In an embodiment, the second force is caused at least by magnetic interaction between the first permanent magnet 110 and said one or more portion of the frame 1110. Examples in FIGS. 11, 12, and 13, for example.

In an embodiment, the coil 122 is situated directly between said one or more portion of the frame 1110 and the first permanent magnet 110. Again, examples may be seen in FIGS. 11, 12, and 13.

Figure 14:
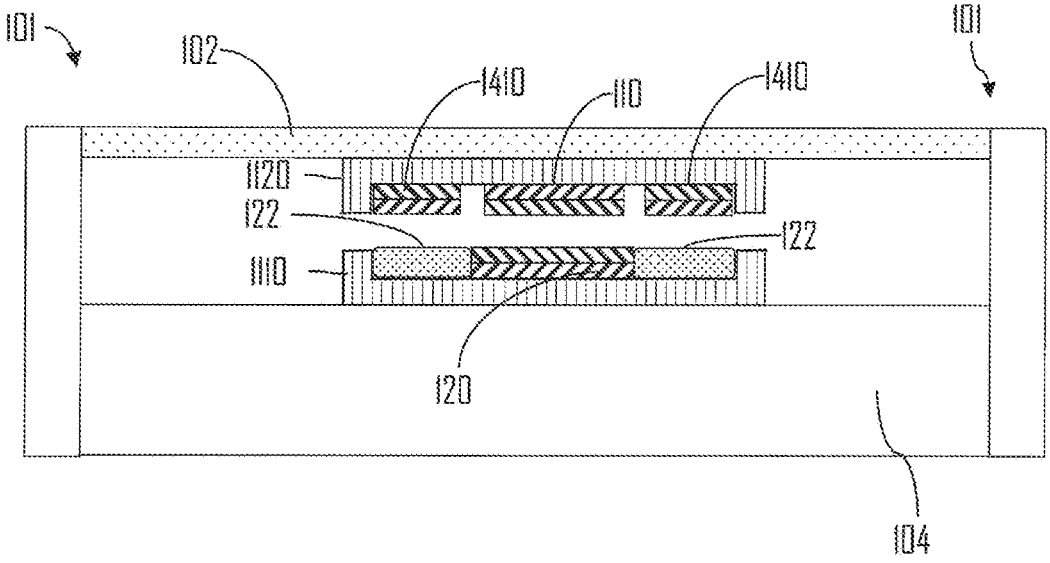

FIG. 14 illustrates an embodiment. Referring to FIG. 14, the first permanent magnet arrangement further comprises a third permanent magnet 1410 configured to face said one or more portion of the frame 1110 (i.e. the portion(s) that extend over the edge area of the second permanent magnet 120) in order to generate the magnetic interaction between said one or more portion of the frame 1110 and the first permanent magnet arrangement.

In an embodiment, the third permanent magnet 1410 is configured to encircle the first permanent magnet 110. For example, thus the third magnet 1410 may be a permanent ring magnet.

It is further possible that the third permanent magnet 1410 magnetically interacts directly with the second permanent magnet 120. Thus, for example, this may generate a further pulling force or increase magnitude of the second force.

Hence, for example, the first permanent magnet arrangement may comprise two permanent magnets 110, 1410 with opposing magnetic polarizations and an iron cup (e.g. frame 1120) all coupled together. The second permanent magnet 120 may generate a repulsing force (i.e. first force) with the first permanent magnet 110, and attractive force with the third magnet 1410 (i.e. second force).

For example, magnets and iron cup (frame 1110 and/or 1120 may also be referred to as iron cups) dimensions and materials are selected in such a way that these repulsing and attracting forces compensate each other at the designed center position in up-down direction when there is no electrical input signal in the coil 122 (e.g. speech coil). Electrical input signal creates additional force on surface. This force can be repulsive or attractive depending on the direction of the current, thus alternating current in the coil 122 makes surface part vibrating in up-down direction according to electrical input signal.

In the example embodiment of FIG. 14, the first permanent magnet 110 does not necessarily have substantial magnetic interaction with the frame 1110. Hence, the second force may be cause by interaction between the third and second permanent magnets 1410, 120 and possibly between the one or more portion of the frame 1110 and the third permanent magnet 1410.

In an embodiment, the frame comprises a cavity for the coil 122 and the second permanent magnet 130. Example of this may be seen in FIG. 11, for example.

In an embodiment, the first permanent magnet arrangement comprises a second frame 1120 comprising magnetic material, the second frame 1120 configured to be magnetized by one or more permanent magnets (e.g. 110) of the first permanent magnet arrangement in order to increase the second force caused by the magnetic interaction between the first permanent magnet arrangement and said one or more portions of the frame 1110 coupled with the second permanent magnet 120. Examples of this can be seen in FIGS. 11, 12, and 14. As shown in FIG. 13, the use of the second frame 1120 may not be necessary. However, using the second frame 1120, may further enhance the configurability of the second force, for example.

Figure 15:
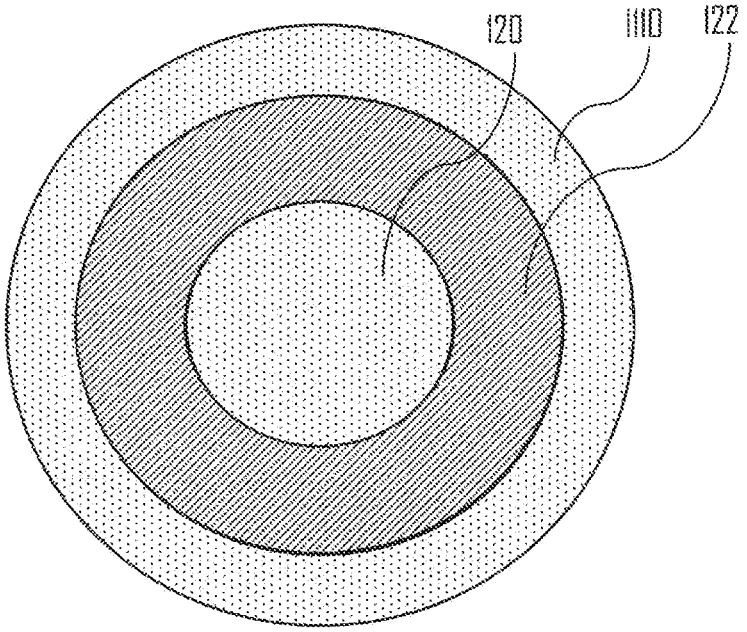
Figure 16:
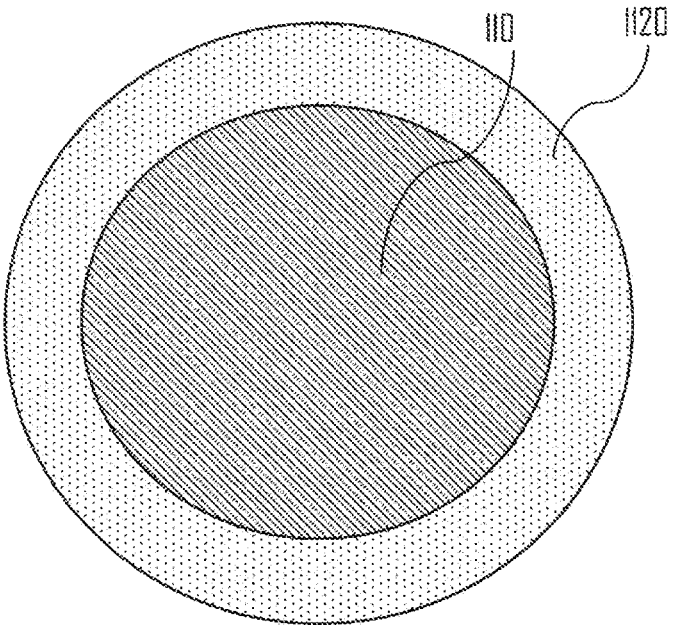

As indicated above, FIGS. 15 and 16 may illustrate some embodiments showing circular second permanent magnet 120 at one part of the arrangement 100 and circular first permanent magnet 110 at the other part of the arrangement 100. Similarly, coil 122 and frame 1110 are shown. Further, if the second frame 1120 is used, it may be disposed as illustrated in FIG. 16. Hence, for example, the second frame 1120 may provide a cavity for receiving/housing the first permanent magnet 110 such that it may be visible at least on one side. Similar housing may be arranged, by using the first frame 1110, for the second permanent magnet 120 and the coil 122.

Even though the invention has been described above with reference to an example according to the accompanying drawings, it is clear that the invention is not restricted thereto but can be modified in several ways within the scope of the appended claims. Therefore, all words and expressions should be interpreted broadly and they are intended to illustrate, not to restrict, the embodiment. It will be obvious to a person skilled in the art that, as the technology advances, the inventive concept can be implemented in various ways. The invention and its embodiments are not limited to the examples described above but may vary within the scope of the claims.

What is claimed is:

1. An arrangement for generating vibration according to an electrical input signal, the arrangement comprising:

a base;

a surface supported with respect to the base by at least one supporting member;

a first permanent magnet arrangement coupled with the surface and comprising a first permanent magnet;

a frame coupled with the base and comprising magnetic material;

a second permanent magnet configured to be arranged between the first permanent magnet and the frame and to be coupled with the frame, one or more portions of the frame extending at least in one direction over an edge area of the second permanent magnet, wherein the first permanent magnet is between the second permanent magnet and the surface, the second permanent magnet further configured to face, at a distance, the first permanent magnet such that a magnetic interaction between the first permanent magnet and the second permanent magnet causes a first force to the surface of an apparatus, wherein the frame is configured to be magnetized by the same polarity of the second permanent magnet in order to cause magnetic interaction between said one or more portions of the frame and the first permanent magnet arrangement in order to cause a second force to the surface having an opposite direction compared with the first force; and a coil coupled with an input for receiving an electrical input signal, the coil configured to generate a magnetic field according to the electrical input signal in order to displace the surface to generate vibration.

2. The arrangement of claim 1, wherein the coil is configured to be arranged to encircle the second permanent magnet.

3. The arrangement of claim 2, wherein the coil is configured to be situated between said one or more portions of the frame and the first permanent magnet arrangement.

4. The arrangement of claim 1, wherein the frame comprises a cavity to receive the second permanent magnet.

5. The arrangement of claim 1, wherein same polarities of the first and second permanent magnets are configured to face each other.

6. The arrangement of claim 1, wherein a surface area of a surface of the first permanent magnet configured to face the second permanent magnet is greater than a surface area of a surface of the second permanent magnet configured to face the first permanent magnet.

7. The arrangement of claim 6, wherein the second force is configured to be caused at least by magnetic interaction between the first permanent magnet and said one or more portions of the frame.

8. The arrangement of claim 6, wherein the coil is configured to be situated directly between said one or more portions of the frame and the first permanent magnet.

9. The arrangement of claim 1, wherein the first permanent magnet arrangement further comprises a third permanent magnet configured to face said one or more portions of the frame in order to generate the magnetic interaction between said one or more portions of the frame and the first permanent magnet arrangement.

10. The arrangement of claim 1, wherein the third permanent magnet is configured to encircle the first permanent magnet.

11. The arrangement of claim 1, wherein the frame comprises a cavity for the coil and the second permanent magnet.

12. The arrangement of claim 1, wherein the first permanent magnet arrangement comprises a second frame comprising magnetic material, the second frame configured to be magnetized by one or more permanent magnets of the first permanent magnet arrangement in order to increase the second force caused by the magnetic interaction between the first permanent magnet arrangement and said one or more portions of the frame coupled with the second permanent magnet.

13. The arrangement of claim 1, wherein the arrangement is for generating an audio output according to the electrical input signal.

14. The arrangement of claim 1, wherein the arrangement is for generating haptic feedback according to the electrical input signal.

15. The arrangement of claim 1, wherein the coil is configured to be looped around the second permanent magnet.

* * * * *